US009338542B2

(12) United States Patent
Cheng

(10) Patent No.: US 9,338,542 B2
(45) Date of Patent: May 10, 2016

(54) WIRELESS HEADSET HAVING EAR HOOK

(71) Applicant: DEXIN CORPORATION, New Taipei (TW)

(72) Inventor: Wang-Dong Cheng, New Taipei (TW)

(73) Assignee: DEXIN CORPORATION, New Taipei (TW)

( * ) Notice: Subject to any disclaimer, the term of this patent is extended or adjusted under 35 U.S.C. 154(b) by 113 days.

(21) Appl. No.: 14/449,946

(22) Filed: Aug. 1, 2014

(65) Prior Publication Data

US 2016/0037248 A1 Feb. 4, 2016

(51) Int. Cl.
*H04R 1/10* (2006.01)

(52) U.S. Cl.
CPC ..... *H04R 1/105* (2013.01); *H04R 1/1091* (2013.01); *H04R 2420/07* (2013.01)

(58) Field of Classification Search
CPC ..... H04R 5/033; H04R 1/1041
USPC ..... 381/74
See application file for complete search history.

(56) References Cited

U.S. PATENT DOCUMENTS

2011/0096938 A1* 4/2011 Yuan ..... A61F 11/06 381/73.1

* cited by examiner

*Primary Examiner* — Simon King
(74) *Attorney, Agent, or Firm* — Li & Cai Intellectual Property (USA) Office

(57) ABSTRACT

A wireless headset having ear hook includes a device body, a speaker, an electrical charger, a charger cover, and an ear hook. The speaker is coupled to the device body. The electrical charger is arranged in the device body, and the electrical charger is exposed from the device body. The charger cover is coupled to the device body and selectively covers the electrical charger. The ear hook is integrally formed with the charger cover. By the combination of the ear hook and the electrical cover, the amount of parts is reduced, and when not in use, the headset can be electrically charged by lifting the charger cover.

10 Claims, 5 Drawing Sheets

WIRELESS HEADSET HAVING EAR HOOK

BACKGROUND OF THE INVENTION

1. Field of the Invention

The instant disclosure relates to a wireless headset; in particular, to an electrically chargeable wireless headset having ear hooks.

2. Description of Related Art

Radio, speech or music listening can be enjoyed through the convenience of a wireless headset. The headset facilitates the enjoyment of leisure activities at the same time as listening to music. For example, people can enjoy jogging simultaneously with the pleasure of music listening.

Due to advancements in technology, a variety of innovative telecommunications devices and functions have increasingly been provided with more and more uses to enrich convenience, user-friendliness, versatility and entertainment value of the devices. In terms of peripherals of telecommunication devices, the use of headsets is quite common. Conventional headset structure typically includes a body and a speaker in the body in order to apply related electronic products (such as computers, laptops, tablets, Walkman, mobile phones or mobile communication devices). As a result, users can wear the headset for sound transmission directly into the users' ears. The sound will not be distorted due to the transmission of sound through air and outside interferences, so that users can clearly enjoy the audio content provided by the electronic products without affecting the surrounding environment.

A conventional wireless headset can be fixed at one end of the body having an ear hook thereon. When the headset is inserted into the ear, the ear hook can conform to the inner walls of the ear canal in order to provide a fixed standard on sound quality that will not be affected by a loose headset. The conventional wireless headset may be provided with an electrical charger, and also a charger cover. When the connector is not used, the charger cover can cover the electrical charger in order to protect the electrical charger by preventing dust and foreign matter from entering the electrical charger. However, since the wireless headset is provided with an ear hook, an electrical charger, and a charger cover, this leads to an inevitable increase in the amount of headset components.

To address the above issues, the inventor strives via associated experience and research to present the instant disclosure, which can effectively improve the limitation described above.

SUMMARY OF THE INVENTION

The object of the instant disclosure is to provide a wireless headset having ear hook. The integration of an ear hook and a charger cover not only reduces the amount of parts required, but electrical charging can also be provided when the ear hook is not in use and the cover is lifted.

In order to achieve the aforementioned objects, according to an embodiment of the instant disclosure, a wireless headset having ear hook is provided. The wireless headset having ear hook includes a device body, a speaker, an electrical charger, a charger cover, and an ear hook. The speaker is coupled to the device body. The electrical charger is arranged in the device body, and the electrical charger is exposed from the device body. The charger cover is coupled to the device body and selectively covers the electrical charger. The ear hook is integrally formed with the charger cover.

The instant disclosure provides the following improvements:

The ear hook of the instant disclosure is extended from the cover such that the cover and the ear hook are integrally formed. The integration of the ear hook and the cover not only reduces the amount of parts required, but electrical charging can also be provided when the ear hook is not in use and when the cover is lifted.

The cover and the ear hook of the instant disclosure are integrally formed, and the ear hook provides multiple functions such as the function of a handle so that users can hold the ear hook for operating the lifting and covering of the cover.

In order to further understand the instant disclosure, the following embodiments and illustrations are provided. However, the detailed description and drawings are merely illustrative of the disclosure, rather than limiting the scope being defined by the appended claims and equivalents thereof.

DETAILED DESCRIPTION OF THE PREFERRED EMBODIMENTS

First Embodiment

Figure 1:
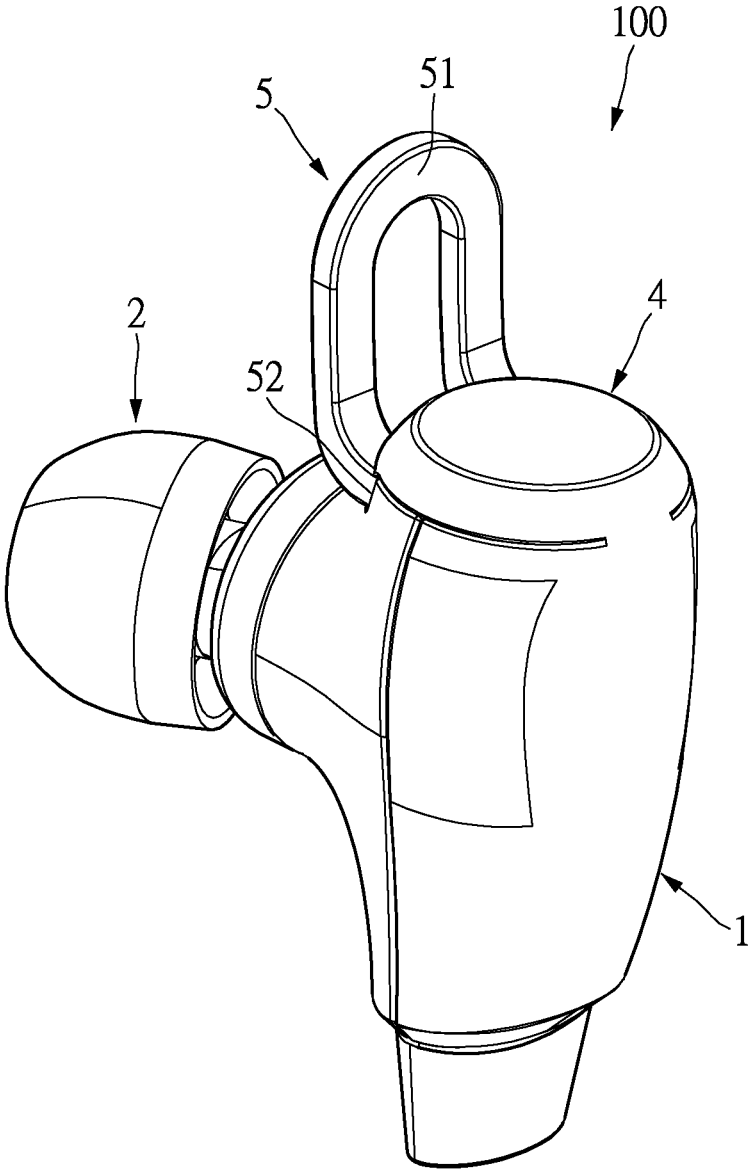
FIG. 1 is a perspective view of a wireless headset having ear hook in accordance with a first embodiment of the instant disclosure.
Figure 2:
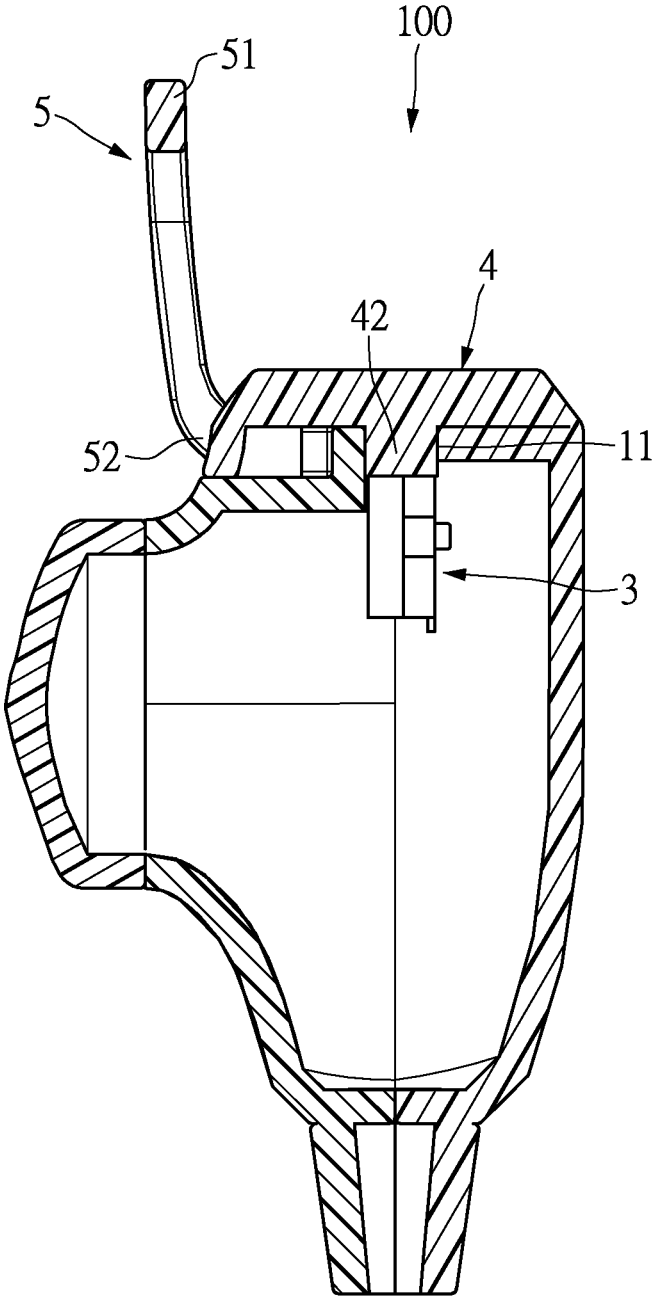
FIG. 2 is a cross-sectional view illustrating a partial structure of the wireless headset having ear hook in accordance with the first embodiment of the instant disclosure.

Please refer to FIGS. 1 and 2. The instant disclosure provides a wireless headset having ear hook structure. The instant embodiment does not limit the type of in-ear or ear bud wireless headset. The wireless headset of the instant disclosure includes a device body 1, a speaker 2, an electrical charger 3, a charger cover 4, and an ear hook 5.

Figure 4:
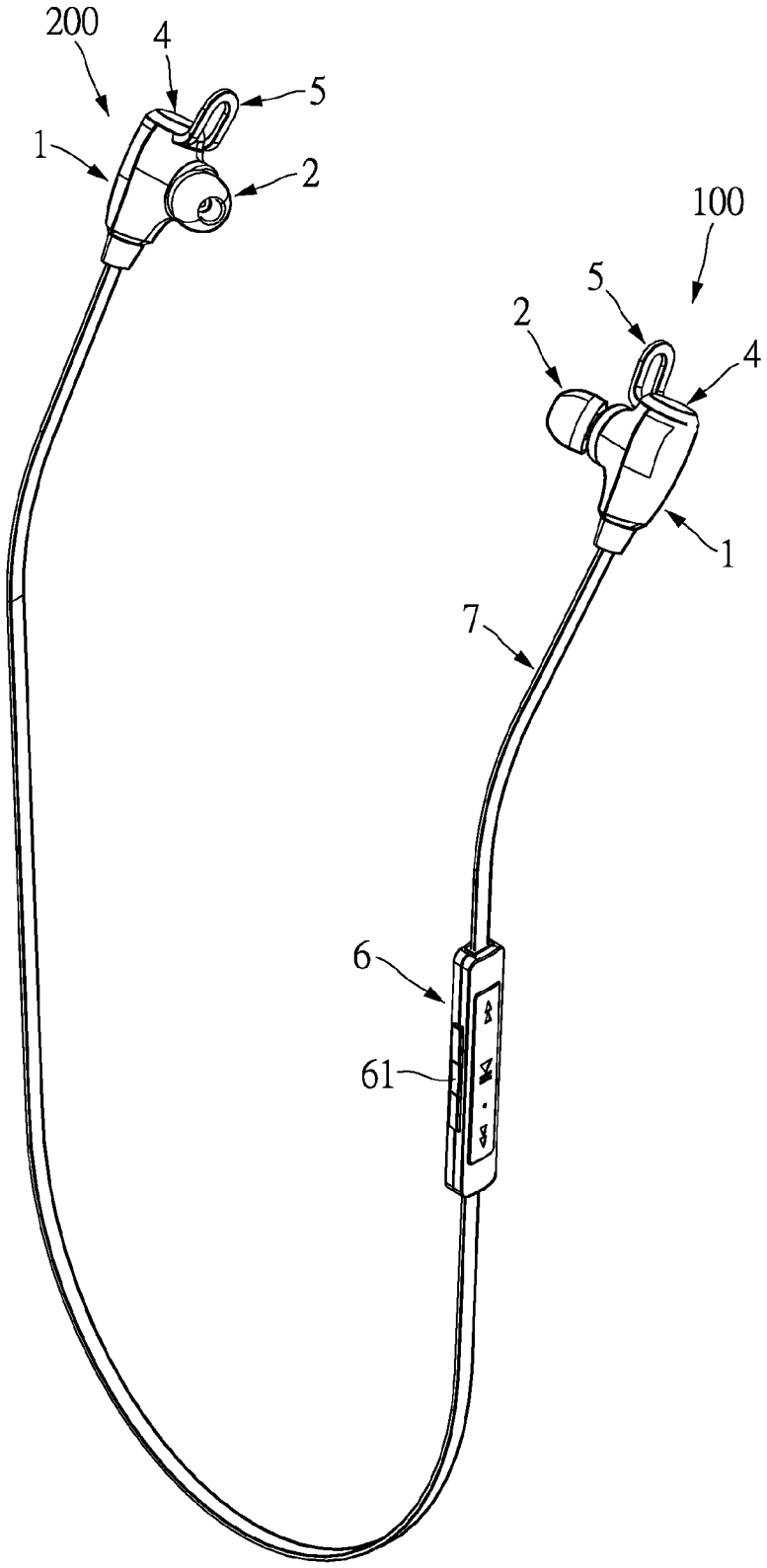
FIG. 4 is a perspective view of the wireless headset having ear hook in accordance with a second embodiment of the instant disclosure.
Figure 5:
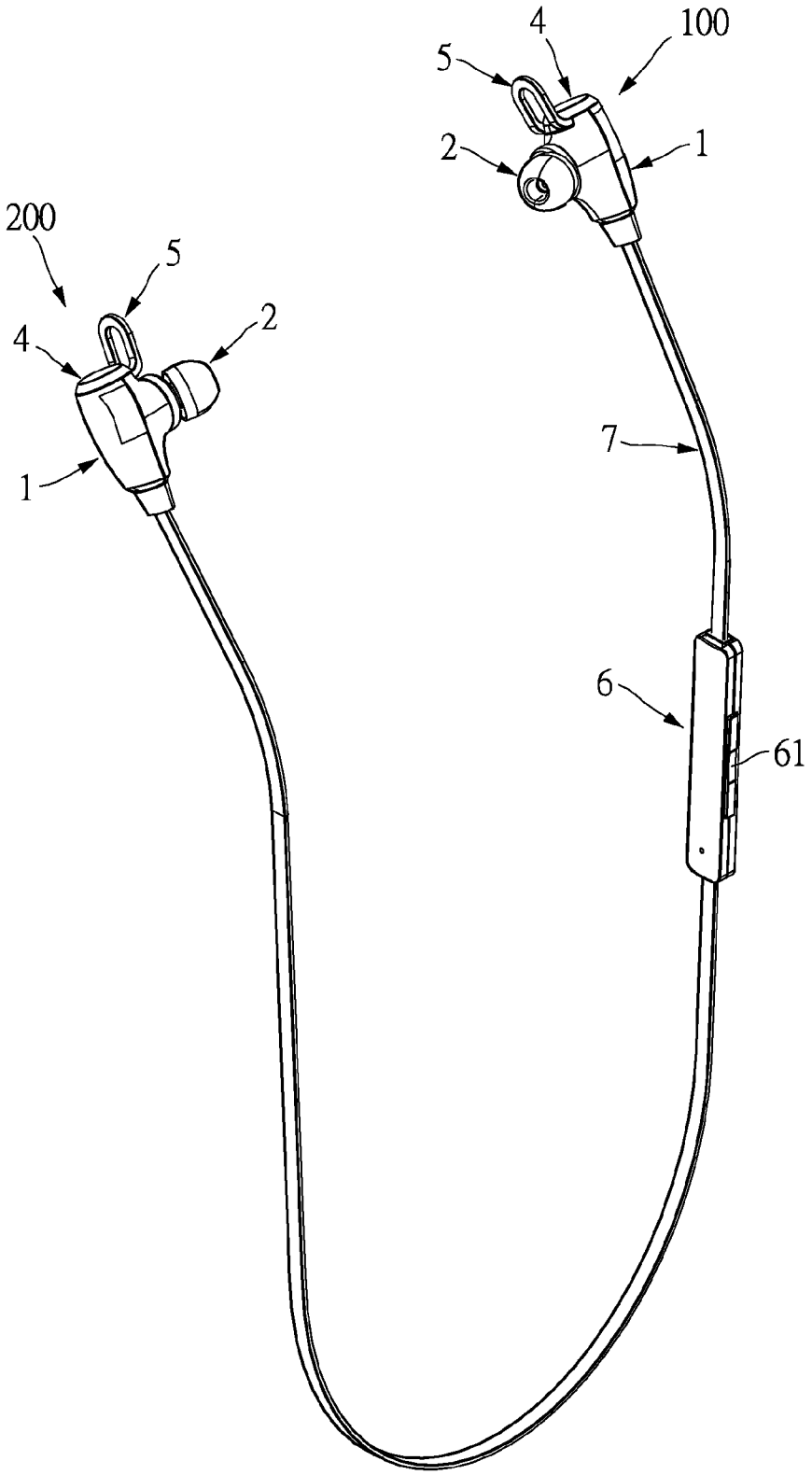
FIG. 5 is another perspective view of the wireless headset having ear hook in accordance with the second embodiment of the instant disclosure.

The device body 1 can be a hollow housing. The device body 1 can include a control circuit unit arranged therein or disposed outside the device body 1 (as shown in FIGS. 4 and 5) as deemed necessary. The speaker 2 is coupled to the device body 1, but the location of the speaker 2 with respect to the device body 1 is not limited to the example provided in the figures or description herein. The speaker 2 can protrude from a side of the device body 1 to facilitate insertion into a users' ear canals. The speaker 2 is electrically connected to the control circuit unit. The control circuit unit can include a wireless control circuit module for signal reception with respect to desktops, laptops, tablets, Walkman, mobile phones, or other types of mobile telecommunication devices products (such as bluetooth, infrared, or similar types of wireless signal communication), as well as for converting electronic signals into wave signals. The wave signals are then transmitted to the speaker 2 for sound generation. Notably, the control circuit unit is a conventional electronic device which is not further described herein.

Figure 3:
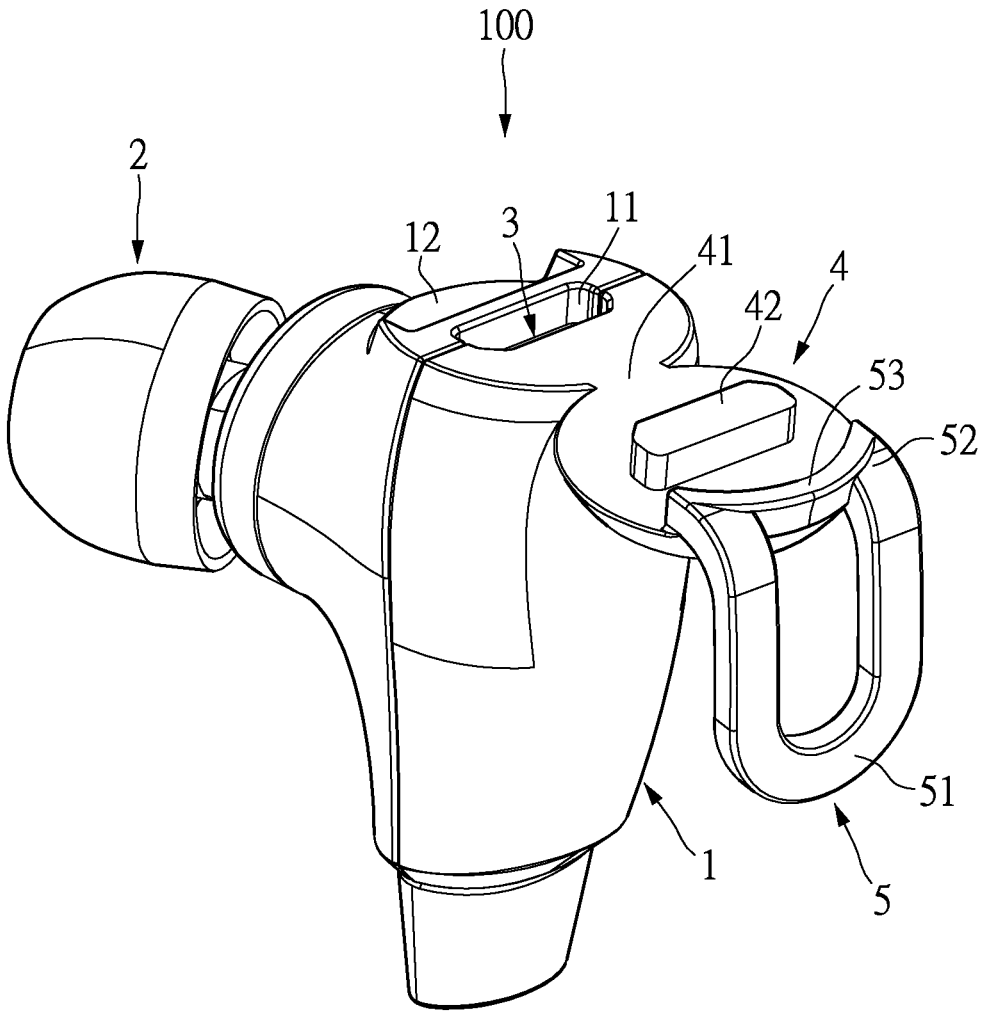
FIG. 3 is a perspective view illustrating a charger cover of the wireless headset having ear hook lifted in accordance with the first embodiment of the instant disclosure.

The electrical charger 3 is arranged in the device body 1, the type of electrical charger 3 is not limited to only USB and can be other similar types of electrical chargers. The electrical charger 3 can be electrically connected to the control circuit unit. The electrical charger 3 is exposed from the device body 1. In the instant embodiment, the device body 1 has a slot 11 arranged thereon. The slot 11 and the electrical charger 3 correspond to each other, such that the electrical charger 3 is exposed from the device body 1 via the slot 11 (as shown in FIG. 3) and facilitates electrical charging of the wireless headset 100 by having a connector connected to a power cord to be correspondingly inserted into the electrical charger 3.

The charger cover 4 resembles a plate shape, but is not limited thereto. The charger cover 4 is coupled to the device body 1. The charger cover 4 can cover the electrical charger 3 selectively. Specifically, the cover 4 has one end integrally formed and connected to the device body 1 via a connector 41. The connector 41 is flexible, such that the cover 4 can be twisted to cover or to be lifted. The cover 4 can enclose the electrical charger 3 by covering it (as shown in FIGS. 1 and 2). The cover 4 can be lifted such that the electrical charger 3 is exposed (as shown in FIG. 3). The cover 4 can also include a protrusion 42 arranged on an inner surface thereof. The protrusion 42 and the slot 11 conform to each other. When the cover 4 encloses the electrical charger 3, the protrusion 42 can be inserted and fixed in the slot 11, such that the cover 4 and the device body 1 are closely coupled to provide preferable securement and protection.

The ear hook 5 is integrally formed and coupled to the cover 4. In other words, the ear hook 5 can be extended from another end of the cover 4. The ear hook 5 is preferably bent to resemble an arc shape. The shape of the ear hook 5 can also be U shaped, circular, or elliptical, but is not limited to examples provided herein. The ear hook 5 in the instant embodiment resembles a U shape. The ear hook 5 has hook body 51 and two end portions 52 coupled or connected to the hook body 51. The two end portions 52 are coupled to an end of the connector 41 distal to the cover 4 such that the cover 4 and the ear hook 5 can be integrally connected to each other as a uni-body structure. Furthermore, a support portion 53 can be arranged between the two end portions 52. The support portion 53 is protruded from an inner surface of the cover 4 and connects the two end portions 52 with the cover 4 in order to reinforce the bonding between the cover 4 and the ear hook 5 as well as strengthen the durability therebetween. The device body 1 can also have a groove 12 that corresponds to the support portion 53. The support portion 53 can be accommodated in the groove 12 when the cover 4 encloses the electrical charger 3.

The ear hook 5 and the cover 4 have a predetermined angle therebetween but the angle is not limited. In the instant embodiment, the cover 4 is horizontally arranged (as shown in FIGS. 1 and 2). The ear hook 5 is extended from an end of the cover 4, such that the ear hook 5 is erected on the cover 4. The ear hook 5 is arranged between the cover 4 and the speaker 2 when the cover encloses or covers the electrical charger 3. When the speaker 2 of the wireless headset 100 is inserted into an ear, the ear hook 5 can correspondingly abut the inner walls of an ear canal in order to be fixed therein and to prevent it from affecting sound quality when the headset is loosened.

The ear hook 5 of the instant disclosure is extended from the cover 4 such that the cover 4 and the ear hook 5 are integrally formed. The integration of the ear hook 5 and the cover 4 not only reduces the amount of parts required, but electrical charging can also be provided when the ear hook 5 is not in use and the cover 4 is lifted (as shown in FIG. 3).

Moreover, since the cover 4 and the ear hook 5 of the instant disclosure are integrally formed, the ear hook 5 provides multiple functions such as the function of a handle so that users can hold the ear hook 5 for operating the lifting and covering of the cover 4.

Second Embodiment

Please refer to FIGS. 4 and 5. The wireless headset 100 of the instant disclosure can be adapted to another wireless headset 200 for use. However, the other wireless headset 200 is not necessarily required to be equipped with an electrical charger 3. The cover 4 can be fixed on the device body 1. The speakers 200 and the electrical chargers 3 of the wireless headsets 100, 200 are electrically connected to the control circuit unit 6 via a signal cord 7. The control circuit unit 6 has a plurality of control keys 61 arranged thereon. The control keys 61 sends command signals after the keys 61 are depressed. The command signals can instruct the wireless headsets 100, 200 to operate accordingly.

The figures and descriptions supra set forth illustrate the preferred embodiments of the instant disclosure; however, the characteristics of the instant disclosure are by no means restricted thereto. All changes, alternations, combinations or modifications conveniently considered by those skilled in the art are deemed to be encompassed within the scope of the instant disclosure delineated by the following claims.

What is claimed is:

1. A wireless headset having ear hook, comprising:
- a device body;
- a speaker coupled to the device body;
- an electrical charger arranged in and exposed from the device body;
- a charger cover coupled to the device body and selectively covering the electrical charger; and
- an ear hook integrally formed with the charger cover.

2. The wireless headset having ear hook as recited in claim 1, wherein the device body has a slot arranged thereon, the electrical charger is exposed from the device body via the slot, the charger cover has a protrusion arranged on an inner surface thereof, when the charger cover covers the electrical charger, the protrusion is fixed in the slot.

3. The wireless headset having ear hook as recited in claim 1, wherein the charger cover has two ends, one end of the charger cover is coupled to the device body through a connector, and the ear hook extends from the other end of the charger cover.

4. The wireless headset having ear hook as recited in claim 3, wherein the connector is flexible.

5. The wireless headset having ear hook as recited in claim 3, wherein the ear hook has a hook body and two end portions coupled to the hook body, the two end portions are coupled to the end of the charger cover distal to the connector.

6. The wireless headset having ear hook as recited in claim 5, wherein the two end portions have a support portion arranged therebetween, the support portion protrudes from an inner surface of the charger cover, and the support portion couples the two end portions and the charger cover.

7. The wireless headset having ear hook as recited in claim 6, wherein the device body has a slot arranged thereon, the support portion is accommodated in the slot when the charger cover covers the electrical charger.

8. The wireless headset having ear hook as recited in claim 1, wherein the ear hook is upwardly extended from an end of the charger cover, and the ear hook is erected on the charger cover.

9. The wireless headset having ear hook as recited in claim 1, wherein the ear hook resembles a U shaped.

10. The wireless headset having ear hook as recited in claim 1, wherein the ear hook is arranged between the charger cover and the speaker when the charger cover covers the electrical charger.

* * * * *